US008169289B2

(12) United States Patent
Tabuchi et al.

(10) Patent No.: US 8,169,289 B2
(45) Date of Patent: May 1, 2012

(54) REACTOR

(75) Inventors: Toshihide Tabuchi, Osaka (JP); Takenori Kunimi, Osaka (JP)

(73) Assignee: Tabuchi Electric Co., Ltd., Osaka (JP)

( * ) Notice: Subject to any disclaimer, the term of this patent is extended or adjusted under 35 U.S.C. 154(b) by 0 days.

(21) Appl. No.: 12/735,814

(22) PCT Filed: Feb. 22, 2008

(86) PCT No.: PCT/JP2008/000313

§ 371 (c)(1),
(2), (4) Date: Aug. 19, 2010

(87) PCT Pub. No.: WO2009/104221

PCT Pub. Date: Aug. 27, 2009

(65) Prior Publication Data

US 2010/0321142 A1 Dec. 23, 2010

(51) Int. Cl.
*H01F 27/28* (2006.01)
*H01F 21/02* (2006.01)
*H01F 27/04* (2006.01)

(52) U.S. Cl. ..... 336/222; 336/147; 336/170; 336/180; 336/186; 336/220; 336/221

(58) Field of Classification Search ..... 336/131, 336/182, 184, 187–189, 220–222, 147, 170, 336/180, 186
See application file for complete search history.

(56) References Cited

U.S. PATENT DOCUMENTS 3,274,527 A * 9/1966 Robinson ..... 336/69
4,403,205 A * 9/1983 Leibinger et al. ..... 336/180
5,579,887 A * 12/1996 Leibu et al. ..... 194/317
7,164,331 B2 * 1/2007 Reddy ..... 333/181
7,750,785 B2 * 7/2010 Chen et al. ..... 336/180

FOREIGN PATENT DOCUMENTS

JP 10 097927 A * 4/1996
JP 10-97927 A 4/1998
JP 2000-150271 A 5/2000
JP 2003-124039 A 4/2003
JP 2004-31735 A 1/2004
JP 2007-103399 A 4/2007
JP 2007-103399 A * 4/2007

OTHER PUBLICATIONS

Office Action issued Jul. 11, 2011 for corresponding Chinese Patent Application No. 200880127311.7 with Partial English Translation.

* cited by examiner

*Primary Examiner* — Anh Mai
*Assistant Examiner* — Mangtin Lian
(74) *Attorney, Agent, or Firm* — Birch, Stewart, Kolasch & Birch, LLP.

(57) ABSTRACT

A reactor is provided in which coil segments (5-1, 5-2) of each of first and second auxiliary winding elements (2-1, 2-2) is of a multilayered and aligned winding structure. The coil segments (5-1, 5-2) of the first auxiliary winding element (2-1) and the coil segments (5-1, 5-2) of the second auxiliary winding element (2-2) are disposed within respective space areas (6-1, 6-2) delimited between the coil segments of the second auxiliary winding element and an outside and between the outside and the coil segments of the first auxiliary winding element. The coil segments of each of those first and second auxiliary winding elements are so combined as to be adjacently alternately positioned in a line to thereby form a main winding body (3). The pair of the auxiliary winding elements are connected parallel to each other.

6 Claims, 4 Drawing Sheets

$$f_0 = \frac{1}{2\pi\sqrt{LC_0}}\,[\mathrm{Hz}]$$

$$f_{01} = \frac{1}{2\pi\sqrt{LC_0/4}} = 2f_0\,[\mathrm{Hz}]$$

REACTOR

BACKGROUND OF THE INVENTION

1. Field of the Invention

The present invention relates to a compact reactor having a simplified structure and also having a good high frequency characteristic.

2. Description of the Prior Art

The reactor has hitherto been desired to be of a design, in which it can be incorporated in various inverter or the like to remove, for example, switching noises, has a high performance, along with a compact size and a low cost, and a simplified structure and an easiness to manufacture. In the reactor as shown in FIG. 6A, the resonance frequency f0 at which resonance takes place at the inductance L and distributed capacitance C0 of the winding unit (coil) is expressed by the following equation and, when the frequency is lower than the resonance frequency f0, the winding unit acts as a reactor:

$$f0=1/(2\pi(L\cdot C0)^{1/2})$$

In general, in order to obtain the reactor which is compact in size and low in cost and has a high inductance L, in the case of a multilayer winding method of forming the reactor by winding a round sectioned copper wire helically in a number of layers, the distributed capacitance C0 of the resultant coil tends to become high and the resonance frequency f0 tends to become low and the winding does no longer function as a reactor at a high frequency region, accompanied by reduction of the high frequency characteristic. On the other hand, at the low frequency region, if the number of windings increase, the direct current resistance Rdc of the winding becomes high, accompanied by an increase of the current loss or the like. On the other hand, lowering of the direct current resistance Rdc require the use of a wire thick enough to make it difficult to wind and also to compactize.

In the meantime, as a reactor having a good high frequency characteristic, the reactor of a rectangular sectioned flat wire wound type or a rectangular wire spirally wound type, in which the rectangular wire having a large width for a given thickness is wound spirally has hitherto been well known in the art. See, for example, the Patent Document 1 listed below. In this edgewise winding, since the distributed capacitance is so small that the resonance frequency f0 becomes high and, therefore, the reactor excellent in high frequency characteristic can be obtained.

The reactor of a structure, in which the rectangular wire is wound a number of turns in overlapped fashion and which has a volumetric efficiency comparable to that of the edgewise winding, has also been known in the art. See, for example, the Patent Document 2 listed below.

[Patent Document 1] JP Laid-open Patent Publication No. H10-97927

[Patent Document 2] JP Laid-open Patent Publication No. 2003-124039

It has, however, been found that the edgewise winding requires the use of a substantial length of a winding wire for the coil in order to secure a high inductance. To reduce the length of the winding wire the use of the rectangular wire having a large vertical to lateral ratio (ratio between the height and the width) and, therefore, it is impossible to reduce the size of and the cost of the reactor. On the other hand, the rectangular wire requires a high cost and requires an increased number of assembling steps, accompanied by a low yield. Also, even where the volumetric efficiency comparable to that achieved by the edgewise winding is achieved by the use of the rectangular wire, simplification of the structure and reduction in cost cannot be accomplished sufficiently.

SUMMARY OF THE INVENTION

Accordingly, the present invention has been devised to substantially eliminate the above discussed problems and inconveniences and is intended to provide a reactor having a good high frequency characteristic, which is simplified in structure and compact in size.

In order to accomplish the foregoing object of the present invention, a reactor designed in accordance with the present invention includes at least one pair of auxiliary winding elements each having a plurality of coil segments spaced a distance from each other in a direction of a winding axis, and a core made of a magnetic material. Each of the coil segments is wound with a winding wire in a multilayered and aligned winding fashion. Of the pair of the auxiliary winding elements, the coil segments of the first auxiliary winding element are accommodated within respective space areas, which are delimited respectively between the coil segments of the second auxiliary winding element and an outside in the direction of the winding axis of those coil segments of the second auxiliary winding elements, whereas the coil segments of the second auxiliary winding elements are accommodated within respective space area, which are delimited respectively between an outside in the direction of the winding axis of the coil segments of the first auxiliary winding element and the coil segments of the first auxiliary winding element. The coil segments of each of those first and second auxiliary winding elements are so combined as to be adjacently alternately positioned in the direction of the winding axis in a line. The first and second auxiliary winding elements are connected parallel to each other to form a main winding body having a hollow defined therein. The core referred to above is inserted into the hollow of the main winding body.

According to the above described construction, the coil segments of each of the auxiliary winding elements is of a multilayered and aligned winding structure and the respective coil segments of those first and second auxiliary winding elements are arranged respectively in the space areas each defined between the second and first auxiliary winding elements and the outside, with the coil segments of each of the first and second auxiliary winding elements positioned adjacently alternately in a line to form the main winding body and also to form the divided winding composed of a plurality of divided winding segments, with the first and second auxiliary winding elements being connected parallel to each other. For this reason, the main winding body is reduced in size; due to the divided winding, the overall distributed capacitance of the coil segments is lowered and, therefore, a high resonance frequency can be obtained; and due to the parallel connection, the overall serial resistance is lowered. Accordingly, with a simplified and compact construction, the reactor having a low direct current resistance and a good high frequency characteristic can be obtained.

In a preferred embodiment of the present invention, the coil segments of the first auxiliary winding element and the coil segments of the second auxiliary winding element are wound in respective directions reverse to each other and a winding start of the coil segments of the first auxiliary winding element and a winding end of the second auxiliary winding element are connected to form a parallel connection. Accordingly, the symmetry of arrangement of the coil segments at the input and output sides can be secured and since the impedance characteristic at the high frequency region remains the same at the input and output sides, the high frequency impedance can be stabilized.

A material for the winding wire may preferably be in the form of a round sectioned wire with a circular or elliptic sectional shape. Accordingly, since a all purpose wire is employed, a low cost can be accomplished. Also preferably, the main winding body is made up of two auxiliary winding elements and each of the first and second auxiliary winding elements is made up of two coil segments.

In another preferred embodiment of the present invention, the main coil body is provided in a pair and in which the core comprises a generally rectangular core made of the magnetic material and having a pair of arms that are inserted into respective hollows of the main winding bodies. Accordingly, the reactor having a good high frequency characteristic can be obtained with a simplified and compact construction.

BRIEF DESCRIPTION OF THE DRAWINGS

In any event, the present invention will become more clearly understood from the following description of preferred embodiments thereof, when taken in conjunction with the accompanying drawings. However, the embodiments and the drawings are given only for the purpose of illustration and explanation, and are not to be taken as limiting the scope of the present invention in any way whatsoever, which scope is to be determined by the appended claims. In the accompanying drawings, like reference numerals are used to denote like parts throughout the several views, and:

DESCRIPTION OF THE PREFERRED EMBODIMENTS

Figure 1:
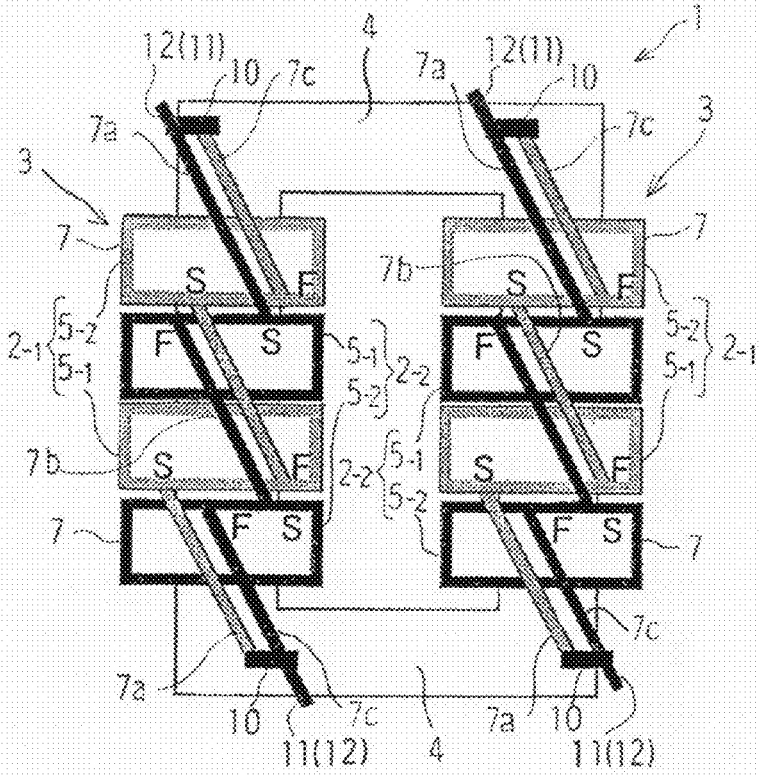
FIG. 1 is a schematic top plan view showing a reactor according to a preferred embodiment of the present invention.

Hereinafter, a preferred embodiment of the present invention will be described in detail with reference to the accompanying drawings. In particular, FIG. 1 illustrates in a schematic top plan view, a reactor designed in accordance with the preferred embodiment of the present invention. The illustrated reactor 1 includes a pair of main winding bodies 3, each comprised of a plurality of, for example, two, pairs of first and second auxiliary winding elements 2-1 and 2-2, and is made up of a combination of those main winding bodies 3 and 3 with a generally rectangular core 4 made of a magnetic material and having bridges and arms assembled together to render it to represent a rectangular shape. While each of the main winding bodies 3 and 3 has a hollow bound by the corresponding winding, the main winding bodies 3 and 3 and the core 4 are assembled together with the core arms extending through the hollows.

Figure 2:
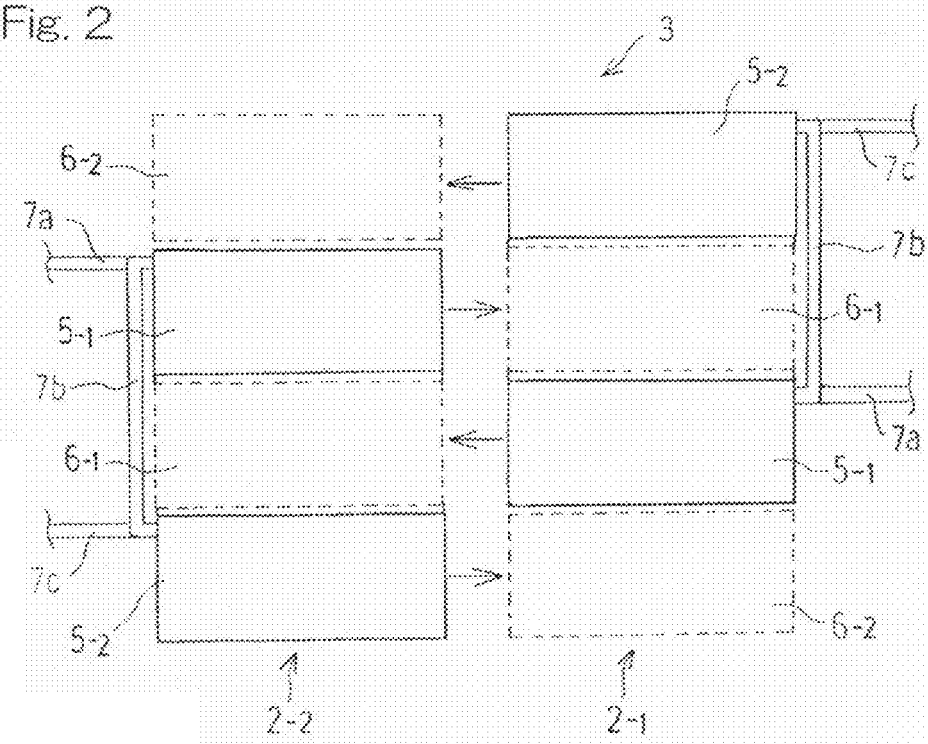
FIG. 2 is a top plan view showing a manner of placement of auxiliary winding elements shown in FIG. 1.

In FIGS. 1 and 2, the symbol "S" represents the start of winding to form multilayered and aligned winding coil segments 5-1 and 5-2 and the symbol "F" represents the end of winding to form those coil segments. As can readily be seen from FIG. 1, each of the coil segments is formed by winding the conductive wire from the point F of one multilayered and aligned winding coil segment to the point S of the next adjacent multilayered and aligned winding coil segment, terminating at the point F.

FIG. 2 illustrates in a schematic top plan representation, the manner in which the pair of the auxiliary winding elements 2-1 and 2-2 of the main winding body 3. In the description that follows, reference will be made to only one of the first and second auxiliary winding elements 2-1 and 2-2, for example, the first auxiliary winding element 2-1 for the sake of clarity.

The first auxiliary winding element 2-1 includes a plurality of, for example, two, coil segments 5-1 and 5-2 that are spaced from each other in a direction conforming to the direction of a winding axis. The coil segments 5-1 and 5-2 have a winding wire wound in a multilayered and aligned winding fashion and two space areas 6-1 and 6-2, which are capable of accommodating respective equivalents of the coil segments 5-1 and 5-2 therein, are provided between the coil segments 5-1 and 5-2 and outside of the coil segment 5-1 in the direction conforming to the direction of the winding axis. In other words, the first auxiliary winding element 2-1 is of a design, in which the two coil segments 5-1 and 5-2 and the space areas 6-1 and 6-2 are alternately positioned relative to each other in the direction of the winding axis with each coil segment intervening between the space areas. Those coil segments 5-1 and 5-2 correspond to two divided winding portions intervening the space area 6-1 with the winding wire 7 continued between those coil segments and form a divided winding structure.

The main winding bodies 3 referred to previously are formed in such a manner that the coil segments 5-1 and 5-2 of one of the auxiliary winding elements of one pair, that is, the first auxiliary winding element 2-1 are arranged in the space areas 6-1 and 6-2 of the second auxiliary winding element 2-2 whereas the coil segments 5-1 and 5-2 of the second auxiliary winding element 2-2 are arranged in the space areas 6-1 and 6-2 of the first auxiliary winding element 2-1. As such, the coil segments 5-1 and 5-2 of each of the first and second auxiliary winding elements 2-1 and 2-2 are combined in adjoining relation to each other in the direction of the winding axis so as to be lined in a row in alternately adjoining relation to each other and with the first and second auxiliary winding elements 2-1 and 2-2 being connected parallel to each other. In other words, the pair of the first and second auxiliary winding elements 2-1 and 2-2 are connected parallel to each other by means of a parallel connection 10 (FIG. 3) in a condition, in which the coil segment 5-2 of the first auxiliary winding element 2-1, the coil segment 5-1 of the auxiliary winding element 2-2, the coil segment 5-1 of the first auxiliary winding element 2-1 and the coil segment 5-2 of the auxiliary winding element 2-2 are arranged in a row in this specific order in the direction of the winding axis in this order. Since by so doing, the first and second auxiliary winding elements 2-1 and 2-2 are juxtaposed in a line relative to each other with the coil segments 5-1 and 5-2 of a divided winding structure and the coil segments 5-1 and 5-2 are juxtaposed in a line relative to each other in a multilayered and aligned winding fashion while the pair of the auxiliary winding elements 2-1 and 2-2 are connected parallel to each other, the main winding bodies 3 can be assembled in a compact size. If an electric current is allowed to flow through the main winding bodies 3, for example, if an electric current is allowed to flow with a plus voltage applied to terminals 10, electric currents flowing respectively through the first and second auxiliary winding elements 2-1 and 2-2 flows in the same directions and the magnetic fluxes generated in the cores 4 are also generated in the same direction.

Figure 3:
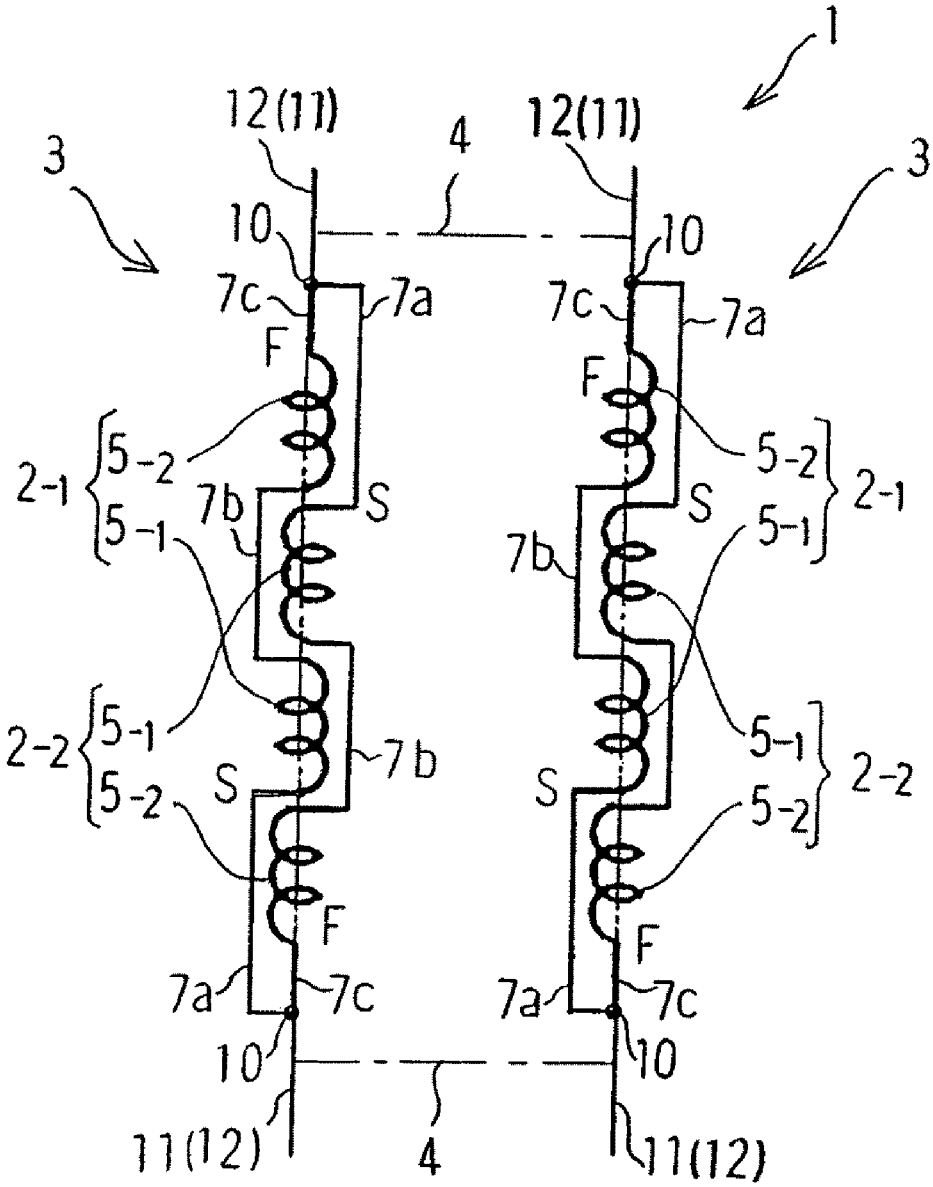
FIG. 3 is a diagram showing an electric equivalent circuit of the reactor shown in FIG. 1.

FIG. 3 is a diagram showing an electric equivalent circuit of the reactor 1 of the structure shown in FIG. 1. The main winding body 3 is made up of the first auxiliary winding element 2-1 referred to previously and the second auxiliary winding element 2-2 reversed in position along the winding direction and so arranged as hereinbefore described relative to the first auxiliary winding element 2-1, with the use of, the two same auxiliary winding elements. In other words, the main winding body 3 is formed by the first auxiliary winding element 2-1, having the coil segments 5-1 and 5-2 which have been dividedly wound, and the second auxiliary winding element 2-2 having the coil segments 5-1 and 5-2 which are dividedly wound in a direction reverse to the coil segments 5-1 and 5-2 of the first auxiliary winding element 2-1, the first and second auxiliary winding elements 2-1 and 2-2 being connected parallel to each other.

Figure 4A:
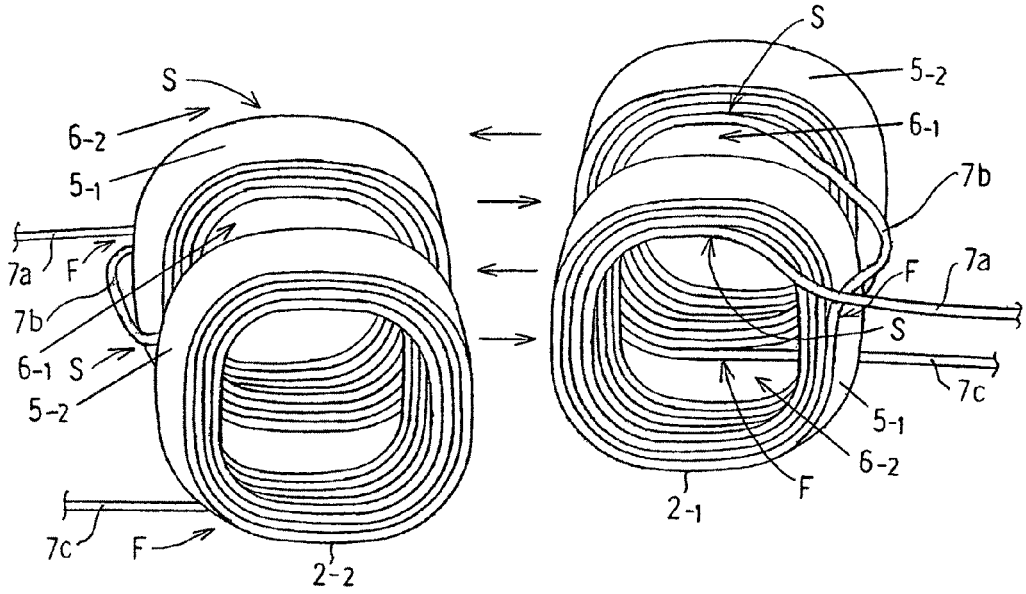
FIG. 4A is a schematic perspective view showing main winding bodies before assemblage.
Figure 4B:
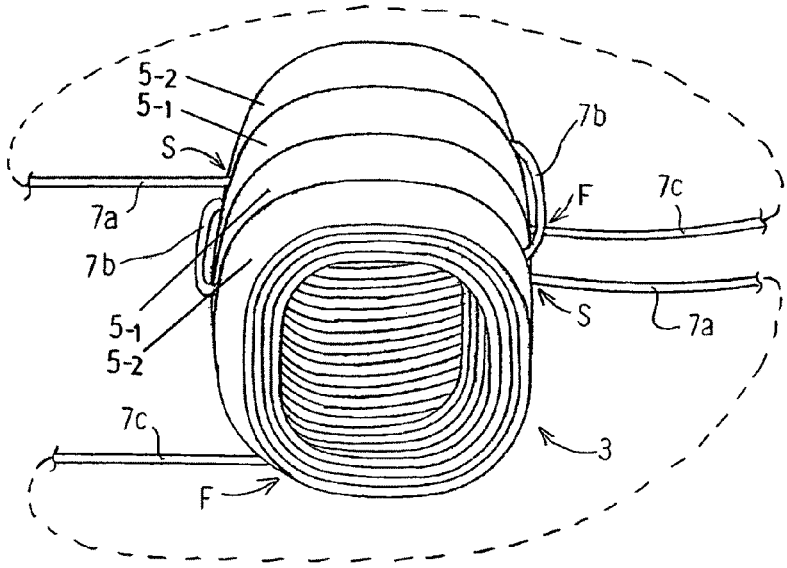
FIG. 4B is a schematic perspective view showing the main winding bodies after assemblage.

FIG. 4A is a schematic perspective view showing one of the main winding bodies 3 before assemblage, and FIG. 4B is a schematic perspective view showing the main winding body 3 after assemblage. Referring first to FIG. 4A, as hereinabove described, the first and second auxiliary winding elements 2-1 and 2-2 are the same to each other, each of the coil segments 5-1 and 5-2 is combined with the respective space area 6-1 and 6-2 while the second auxiliary winding element 2-2 has a winding direction opposite to that of the first auxiliary winding element 2-1, and the coil segments 5-1 and 5-2 of each of the first and second auxiliary winding elements 2-1 and 2-2 have their respective winding directions opposite to each other. The first auxiliary winding element 2-1 is formed by the same continuous winding wire 7, with the winding start S situated in the vicinity of a lead out line 7*a* of the winding wire 7 of the coil segment 5-1 while the coil segments 5-1 and 5-2 are connected together through a connecting line 7*b* of the winding wire 7 with the winding end F situated in the vicinity of a lead out line 7*c* of the winding wire 7 of the coil segment 5-2.

And, as shown in FIG. 4B, the main winding body 3 is formed by connecting the pair of the first and second first and second auxiliary winding elements 2-1 and 2-2 parallel to each other. Specifically, a winding line 7*a* at the winding start S of the coil segment 5-1 of the first auxiliary winding element 2-1 and a winding line 7*c* at the winding end F of the coil segment 5-2 of the second auxiliary winding element 2-2 are connected at the parallel junction 10 (FIG. 3), and a winding line 7*c* at the winding end F of the coil segment 5-2 of the first auxiliary winding element 2-1 and a winding line 7*a* at the winding start S of the coil segment 5-1 of the second auxiliary winding element 2-2 are connected at the parallel junction 10, thereby forming a parallel connection of the pair of the auxiliary winding elements 2-1 and 2-2.

It is to be noted that in place of the parallel connection discussed above, it may be accomplished by the use of two first and second auxiliary winding elements 2-1 and 2-2 having the respective winding directions opposite to each other and arranging the first and second auxiliary winding elements 2-1 and 2-2 in the same orientation relative to each other.

In the embodiment hereinabove described, each of the coil segments 5-1 and 5-2 has been shown and described in the form of, for example, a four layer winding, but the present invention is not necessarily limited thereto. It is to be noted that as compared with a winding in odd numbered layers, a winding in even numbered layers is rather preferred because the shape will hardly collapse in the condition with the winding wire 7 having been would and, also, because the handling can be facilitated as the lead out lines 7*a* and 7*c* at the winding start S and the winding end F appear on the same side as terminals of the coil segments 5-1 and 5-2.

Figure 5:
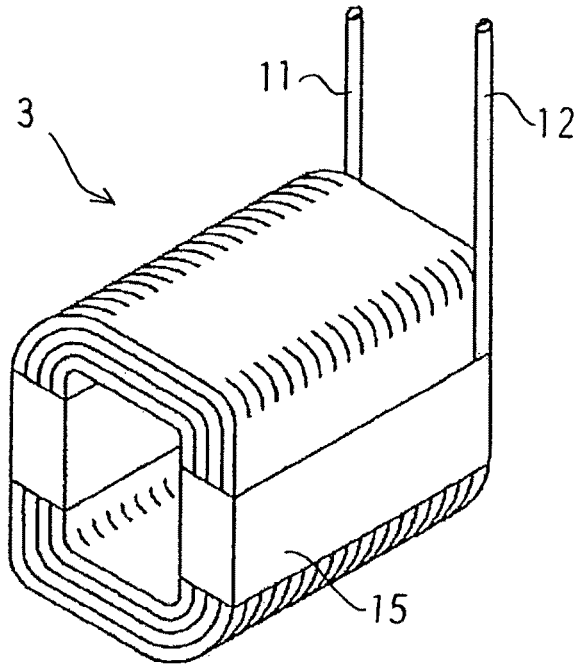
FIG. 5 is a schematic perspective view showing one of the main winding bodies in a completed condition.

FIG. 5 is a schematic perspective view showing one of the main winding bodies 3 in a completed condition. The main winding body 3 shown therein has an input line 11 on an input side and an output line 12 on an output side and the winding wire 7 (lead out lines 7*a* and 7*c* and the connecting line 7*b* for connecting the coil segments 5-1 and 5-2 together) (not shown in FIG. 5) and the parallel junction 10 are concealed inside a fixing tape 15.

Figure 6A:
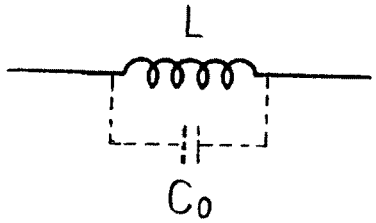
FIG. 6A is a diagram showing an electric equivalent circuit of the winding before divided winding.
Figure 6B:
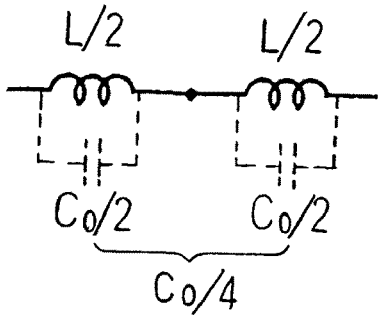
FIG. 6B is a diagram showing an electric equivalent circuit of the winding after divided winding.

As hereinbefore described, as shown in FIG. 6A, in the condition of the coil segments 5-1 and 5-2 before the divided winding, assuming that the inductance of the coil segment is expressed by L and the distributed capacitance is expressed by C0, the resonance frequency f0 can be expressed by $f0=1/(2\pi(L\cdot C0)^{1/2})$. In contrast thereto, where the divided winding of the coil segments 5-1 and 5-2 are employed as shown in FIG. 6B, since the two coil segments 5-1 and 5-2 each having the inductance L/2 and the distributed capacitance C0/2 come to be connected in series with each other, the overall distributed capacitance will become C0/4 and, hence, the distributed capacitance of the entire coil segments will be lowered as compared with the case in which no divided winding is employed. Accordingly, the resonance frequency f01 is expressed by $f01=1/(2\pi(L\cdot C0/4)^{1/2})=2\cdot f0$. Thus, the resonance frequency f01 when the divided winding is employed is twice the resonance frequency f0 when no divided winding is employed, and, hence, the function of a reactor can be obtained to a high frequency region.

Also, since the main winding body 3 is formed by connecting the first and second auxiliary winding elements 2-1 and 2-2 parallel to each other, in contrast to the direct current resistance Rdc of the coil segments 5-1 and 5-2 of each of the first and second auxiliary winding elements 2-1 and 2-2, the overall direct current resistance after the first and second auxiliary winding elements 2-1 and 2-2 have been connected parallel to each other will become Rdc/2, thus being lower than that exhibited before the parallel connection. Accordingly, even with the winding of a thin wire, the parallel connection makes it possible to obtain a low direct current resistance Rdc and also to facilitate winding of the thin wire, accompanied by compactization.

Wire material for the winding wire 7 employed to form each of the coil segments 5-1 and 5-2 of the first and second auxiliary winding elements 2-1 and 2-2 may be employed in the form of a thin and round sectioned wire, having a round sectional shape, such as, for example, a all purpose copper wire. Since it is a round sectioned wire of the all purpose copper wire, a low cost can be achieved. It is, however, to be noted that in place of the round sectioned wire, a litz wire (twisted wire) may be employed.

Since the coil segments 5-1 and 5-2 of each of the first and second auxiliary winding elements 2-1 and 2-2 are of an aligned winding type, in which the thin and round sectioned wire is wound while being aligned in a direction of the winding width, the wire winding process can be easily accomplished by the conventional winding method and a low cost at a high yield can be accomplished. Also, since each of the coil segments 5-1 and 5-1 of the first and second auxiliary winding elements 2-1 and 2-2 is of a type wound in a multilayered winding, the length of the reactor 1 can be reduced for a given number of wire turns even though the number of winding layers is increased.

Although each of the first and second auxiliary winding elements 2-1 and 2-2 has been shown and described as formed by winding a winding wire in a multilayered and aligned winding fashion with no bobbin used, it may be formed by the use of a hollow tubular bobbin made of insulating material such as synthetic resin or the like, in which case the winding wire is to be wound around the bobbin in a multilayered and aligned winding fashion.

As hereinabove described, in the reactor 1 of the present invention the coil segments 5-1 and 5-2 of each of the auxiliary winding elements 2-1 and 2-2 is of a multilayered and aligned winding structure. The respective coil segments 5-1 and 5-2 of those first and second auxiliary winding elements 2-1 and 2-2 are arranged respectively in the space areas 6-1 and 6-2 each defined between the second and first auxiliary winding elements 2-2 and 2-1 and the outside, with the coil segments 5-1 and 5-2 of each of the first and second auxiliary winding elements 2-1 and 2-2 positioned adjacently alternately in a line to form the main winding body 3. Each of the first and second auxiliary winding elements 2-1 and 2-2 is formed by the divided winding composed of a plurality of divided winding segments 5-1 and 5-2, with the first and second auxiliary winding elements 2-1 and 2-2 being connected parallel to each other. Due to the multilayered and aligned winding fashion, the main winding body 3 is reduced in size. Due to the divided winding, the overall distributed capacitance C0 of the coil segments 5-1 and 5-2 is lowered and, therefore, a high resonance frequency can be obtained. Due to the parallel connection, the overall serial resistance Rdc is lowered. Accordingly, with a simplified and compact construction, the reactor having a low direct current resistance Rdc and a good high frequency characteristic can be obtained. As a result thereof, the reactor 1 has a reactor effect to a high frequency region with the simplified and compact construction and, therefore, when used in association with various inverters or the like, switching noised can be removed at a high frequency region.

The reactor 1 of the present invention is of a structure in which the first and second auxiliary winding elements 2-1 and 2-2 have their respective coil segments 5-1 and 5-2 that are would in the directions reverse to each other and, at both of the input and out sides thereof, the winding start S of each of the coil segments 5-1 and 5-2 of the first auxiliary winding element and the winding end F of each of the coil segments 5-1 and 5-2 of the second auxiliary winding element are connected parallel to each other. Accordingly, the symmetry of arrangement of the winding wires 7 can be secured at the input and output sides, that is, the lead out lines 7*a* and 7*c* of the winding wire 7 drawn to the parallel junction 10 are disposed in the same manner at the input and output sides. As a result, the impedance characteristic at the high frequency region remains the same and the high frequency impedance can be stabilized. Also, in view of the symmetry of arrangement of the winding wires 7, it can be used and can easily be handled without the directionality of the main winding bodies 3 being designated during assemblage of the reactor 1 and use thereof.

In the foregoing embodiment, the coil segments 5-1 and 5-2 of the first auxiliary winding element 2-1 and the coil segments 5-1 and 5-2 of the second auxiliary winding element 2-2 are wound in the respective directions reverse to each other and the winding start S and the winding end F thereof are connected to form the parallel connection. Alternatively, arrangement may be made that the coil segments 5-1 and 5-2 of the first auxiliary winding element 2-1 and the coil segments 5-1 and 5-2 of the second auxiliary winding element 2-2 may be wound in the same direction, in which case the winding starts S thereof and the winding ends F thereof are connected with each other to form parallel junctions.

It is to be noted that although in the embodiment of the present invention hereinbefore fully described, the reactor 1 has been shown and described as having the pair of the main winding bodies 3 with the arms of the generally rectangular magnetic element (core) 4 inserted into the respective hollows of the main winding bodies 3, the present invention is not necessarily limited thereto. Two or more pairs of the main winding bodies 3 may be employed and, as is the case with, for example, a choke (stationary) coil for blocking a high frequency current, a core 4 made of a magnetic material may be inserted in a hollow of the single main winding body 3.

It is to be noted that although in the embodiment hereinbefore fully described, the round sectioned winding wire 7 has been shown and described as actually wound to form a plurality of divided windings for each of the coil segments 5-1 and 5-2 and the pair of the auxiliary winding elements 2-1 and 2-2 are connected parallel to each other, sheet coils, each forming a divided winding, may be stacked one above the other to form a pair of auxiliary winding elements which are then connected parallel to each other to form the main winding body 3.

Although the present invention has been fully described in connection with the preferred embodiments thereof with reference to the accompanying drawings which are used only for the purpose of illustration, those skilled in the art will readily conceive numerous changes and modifications within the framework of obviousness upon the reading of the specification herein presented of the present invention. Accordingly, such changes and modifications are, unless they depart from the scope of the present invention as delivered from the claims annexed hereto, to be construed as included therein.

What is claimed is:

1. A reactor which comprises:

at least one pair of auxiliary winding elements, each element being of same configuration and having a plurality of coil segments electrically continuous to each other, in which a plurality of space areas are formed adjacent the coil segment in a direction of a winding axis;

each of the coil segments being wound with a winding wire in a multilayered and aligned winding fashion;

of the pair of the auxiliary winding elements which have winding directions opposite to each other, the coil segments of the first auxiliary winding element being accommodated within respective space areas, which are delimited respectively between the coil segments of the second auxiliary winding element and an outside in the direction of the winding axis of those coil segments of the second auxiliary winding elements, whereas the coil segments of the second auxiliary winding elements are accommodated within respective space area, which are delimited respectively between an outside in the direction of the winding axis of the coil segments of the first auxiliary winding element and the coil segments of the first auxiliary winding element, the coil segments of each of those first and second auxiliary winding elements being so combined as to be adjacently alternately positioned in the direction of the winding axis in a line; and the first and second auxiliary winding elements being connected parallel to each other to form a main winding body having a hollow defined therein; and a core made of a magnetic material and inserted into the hollow of the main winding body.

2. The reactor as claimed in claim 1, in which the coil segments of the first auxiliary winding element and the coil segments of the second auxiliary winding element are wound in respective directions reverse to each other and a winding start of the coil segments of the first auxiliary winding element and a winding end of the second auxiliary winding element are connected to form a parallel connection.

3. The reactor as claimed in claim 1, in which a material for the winding wire comprises a round sectioned wire.

4. The reactor as claimed in claim 1, in which the main winding body comprises two auxiliary winding elements.

5. The reactor as claimed in claim 1, in which each of the first and second auxiliary winding elements comprises two coil segments.

6. The reactor as claimed in claim 1, in which the main coil body is provided in a pair and in which the core comprises a generally rectangular core made of the magnetic material and having a pair of arms that are inserted into respective hollows of the main winding bodies.

* * * * *